US005916346A

United States Patent [19]

Neal

[11] Patent Number: 5,916,346

[45] Date of Patent: Jun. 29, 1999

[54] DIE CUTTER BLANKET

[75] Inventor: Kenneth Ray Neal, Magnolia, Tex.

[73] Assignee: Robud, Pinebrook, N.J.

[21] Appl. No.: 08/943,296

[22] Filed: Oct. 14, 1997

[51] Int. Cl.[6] ..... B26D 7/20

[52] U.S. Cl. ..... 83/659; 83/347; 83/698.42

[58] Field of Search ..... 83/659, 347, 698.42; 492/48; 101/415.1

[56] References Cited

U.S. PATENT DOCUMENTS

| | | | |
|---|---|---|---|
| 3,882,750 | 5/1975 | Duckett et al. | 83/659 |
| 4,031,600 | 6/1977 | Whigham | 83/659 X |
| 4,073,207 | 2/1978 | Kirkpatrick | 83/659 |
| 4,191,076 | 3/1980 | Bollmer et al. | 83/659 X |
| 4,848,204 | 7/1989 | O'Connor et al. | 83/659 |
| 4,867,024 | 9/1989 | Cho et al. | 83/659 |
| 5,076,128 | 12/1991 | O'Connor et al. | 83/659 |
| 5,078,535 | 1/1992 | Kirkpatrick | 83/659 X |
| 5,720,212 | 2/1998 | Kirkpatrick | 83/659 |
| 5,758,560 | 6/1998 | Fiscus | 83/659 |

*Primary Examiner*—Eugenia A. Jones

*Attorney, Agent, or Firm*—William Squire

[57] ABSTRACT

A polyurethane layer is bonded to a sheet metal liner and secured to an anvil roller channel by depending interlocking male and female locking members at the respective blanket ends. The female locking member comprises a U-shaped channel member formed from the liner. The channel member has an extension formed of doubled over sheet material with an inclined lip for engaging the anvil channel in resilient interference fit in cooperation with a distal channel member side wall. The channel member is filled with the layer material as the layer is formed to form a solid female member and has a lateral side wall from which a locking projection extends for locking engagement with a mating recess in the male member. A wedge projection projects from a face of the male member contiguous with the outer blanket surface. The wedge projection extends from the blanket outer surface an extent smaller than the blanket layer thickness to minimize insertion load on the male member due to interference with the female member. This projection compresses during installation and expands during use to fill a gap that otherwise would form between the blanket end faces.

19 Claims, 2 Drawing Sheets

DIE CUTTER BLANKET

Of interest is commonly owned application Ser. No. 735,920 entitled Locking Arrangement for Die Cutter Blanket filed Oct. 24, 1996 in the name of Alan D. Kirkpatrick, now U.S. Pat. No. 5,720,212.

This invention relates to locking devices for locking flexible elements, e.g., flexible die cutter blankets, for wrapping about a cylindrical rotary die cutter anvil.

Rotary die cutting relates to die cutting a moving work pieces e.g., a continuously moving web of sheet material such as paperboard, without interrupting the web movement. See for example, U.S. Pat. No. 5,078,535 incorporated by reference herein. Moving webs or discrete sheets of sheet material, e.g., cardboard or corrugated paperboard, are passed between a cutting roller and an anvil roller. Cutters are mounted on the cutting roller and rotate therewith. The anvil roller has a cylindrical cover referred to as a cutting die blanket which encircles the anvil roller. The rollers rotate about parallel axes and are displaced an amount such that the cutters penetrate the surface of the die cutting blanket during cutting of the sheet material web passing therebetween.

The blankets are flexible sheets which are wrapped about the anvil roller. The anvil roller which typically is metal, but in certain implementations is encased within a two piece slip cylindrical bearing, made of hard polyurethane, which in turn is then wrapped with a cutting die blanket, has a channel in a surface thereof extending parallel to the axis of rotation of the anvil roller. Where the bearing is present, the channel is formed in a surface thereof instead of in the metal anvil roller. See for example U.S. Pat. Nos. 5,076,128 and 4,073,208 incorporated by reference herein.

The blankets are molded of elastically deformable urethane or other materials, such as polyurethane, polyvinyl chloride, chlorinated butyl rubber and so on onto the surface of a liner, typically thin sheet metal, or thin fiber sheets, wire reinforced rubber and so on. The blanket is generally formed in sheets of about 60 inches long and from 8 to 12 inches wide. The anvil roller may be 110 inches long and 20 inches in diameter. To cover the roller, ten to twelve blankets are employed and wrapped about the roller, the blankets abutting one another edge to edge on the roller.

The blankets are secured to the roller by locking devices that engage the channel in the anvil roller surface. A major problem is that the blanket locking devices must permit the blankets to be assembled and removed from the anvil with minimum effort. The locking devices typically comprise interlocking male and female members secured to adjacent ends of the blanket. The interlocking male and female members are inserted into the channel typically by forcing the mating members together during insertion into the channel.

The female member is typically inserted first and secured to the anvil at the base of the channel by a bolt. See U.S. Pat. No. 5,078,535, FIG. 8, for an example of the use of such a bolt. Another arrangement for securing the female member in the channel uses ribs on the female member and undercut grooves in the channel as disclosed, for example, in U.S. Pat. No. 5,076,128. The female ribbed member is inserted endwise into the channel and grooves. This latter arrangement has not met with commercial success because the channel is specially designed with the grooves. A locking device design needs to take into consideration that blankets need to be installed in commercially available anvil rollers whose channels do not have such grooves and would be prohibitively costly to form such grooves therein.

Various locking devices for locking the ends of a blanket to a channel in the anvil roller are disclosed, for example, in U.S. Pat. Nos. 3,739,675; 3,882,750; 4,191,076; 3,633,246 and 4,867,024 among others.

A problem recognized by the aforementioned copending application with the widely used arrangements employing bolts is that the bolts are secured to mating threaded holes having fixed locations in the channel. Generally these fixed locations cause the blankets to have an annular seam centrally of the anvil roller axial length along the anvil axis, see the copending application for further description of this problem. Often, two blanks may be formed from a single web or sheet to be die cut wherein the two blanks are separated by a centrally located cutter. This cutter penetrates the seam and axially separates the blankets even with bolts present. This separation causes defective cutting of the webs.

Another problem recognized by the copending application is that bolts are cumbersome to assemble and disassemble. Further, it is recognized that it would be desirable to use the channels in the prior art anvils that need replacement blankets without the use of bolts. This enhances the time of the blanket assembly and disassembly processes.

In some anvil arrangements, the anvils are axially oscillated to preclude the cutters from penetrating the same blanket at the same location to spread the wear over a wider area to prolong the life of the blankets. The oscillation of the roller causes the cutter to penetrate the blankets in a region. A problem is recognized by the copending application when the cutting action occurs at the central blanket seam fixed axially due to the presence of the bolts. This problem is that penetration of the two adjacent blankets at that seam and wears out two blankets simultaneously. This is wasteful and costly. A need was seen for a locking arrangement which can preclude the wearing of two adjacent blankets.

A locking arrangement according to the copending application for locking a flexible blanket about cylindrical anvil means rotatable about an axis includes compression means for securing a locking member to the anvil means in the channel in compressive interference friction engagement. This compression means is disclosed in one embodiment as a separate compressible element secured to a metal male locking member of the locking means for engagement with the anvil channel or as a separate compressible member for use in the anvil channel in another embodiment. The use of separate compressible elements is also recognized by the present inventor as subject to wear.

Further, the female member is formed of the same material as the blanket and is also subject to undesirable wear. The present inventor recognizes a need to improve the life of the female member and the apparatus disclosed in the aforementioned copending application.

A problem recognized by the present inventor is that the flexible blanket has end faces that abut in a seam in the interlocked state. For reasons not entirely understood, the interlocked end faces separate at the blanket die cutting surface in a wedge shaped opening. This opening is not desirable. If a cutter die is aligned with this opening, a poor cut will be formed as the blanket will not provide the desired support for the sheet material being cut by the die.

In an attempt to overcome this problem, the end face of one end of a prior art blanket was extended and formed inclined to the extent of the blanket entire thickness by the assignee of the present invention. This proved undesirable. The reason is that during insertion, the inclined face prematurely engaged the blanket female member end, interfering with insertion of the male member, making it extremely difficult to engage the male member in the anvil channel in locking engagement with the female member. This approach was abandoned as not practical.

A die cutter blanket for an anvil roll having an anvil channel with opposing side walls according to one aspect of the present invention comprises a flexible strip having first and second ends, the strip for wrapping about the anvil so the first and second ends are adjacent to each other. A female locking member is secured to the first end, the member having interconnected spaced first and second opposing lateral side walls. A locking projection and a relatively resilient anvil engaging element are included, each formed one piece and integral with the locking member and extending from the first lateral side wall in spaced relation to each other, the element and second lateral side wall for locking the locking member and the strip first end to the anvil by compressive interference engagement with the anvil channel. A male locking member is secured to the blanket second end for locking engagement with the female member projection.

In a further aspect, the female member comprises sheet material and the element is generally planar having an edge distal the first lateral wall for resilient engagement of the element with the anvil in the compressive interference engagement.

In a further aspect, the blanket includes a sheet metal liner, the female member being formed of said sheet metal one piece and integral with the liner.

In a still further embodiment, the female locking member is U-shaped with a channel between the lateral first and second walls, the female locking member channel having a base wall, the element being substantially coextensive with and forming an extension of the base wall.

The strip may comprise thermoplastic material overlying a liner, a portion of the material filling the U-shaped channel and being one piece and integral with the strip.

The projection may be V-shaped with the apex of the V extending away from the lateral first and second walls.

In a further aspect, the element comprises folded over sheet material with the fold forming an edge distal the lateral first wall.

The element, in a further aspect, has an edge distal the lateral first wall for the engagement with the anvil channel, a portion of the element next adjacent to the edge is inclined relative to the portion next adjacent to the lateral first wall.

In a further aspect, the blanket includes a sheet metal liner secured to the strip, the female locking member comprises sheet metal secured to the liner, the female locking member comprising a U-shaped member with a base wall interconnecting the lateral side walls forming a further channel therewith, the element comprising an extension of the base wall and comprising a doubled over layer with an edge distal the lateral first wall, the lateral first wall forming the projection spaced from the element, and a lip extending inwardly toward the second lateral wall distal the element and overlying the base wall.

In a further aspect, the strip has an outer surface distal the element, a first face is between the projection and the surface on the first end and is substantially normal to the surface, the strip second end having a recess for receiving the projection, the strip second end between the recess and surface having a second face next adjacent to the recess and substantially normal to the surface, the strip second end between the second face and surface forming a wedge projection extending from the second face and having a third face inclined relative to the second face.

The wedge projection preferably has an surface no greater than about 50% the distance from the strip surface to the recess.

The strip, in a further aspect, is pliable and compressible, the wedge projection extending from the second face a distance so as to compress into and form a substantially continuous face with the second face in the locking engagement.

In a still further aspect, the blanket comprises a flexible compressible strip having opposing first and second ends, the strip for wrapping about the anvil forming a convex outer surface. Interlock means are provided for locking the first and second ends together in locking engagement. The first and second ends each include respective first and second channel engaging members each having a face depending generally normal to and from the outer surface a given extent. A projection extends away from at least one of the faces for a portion of the given extent in a region next adjacent to the outer surface, the projection for compressively engaging the other of the faces during the locking engagement and for expanding and filling a gap that might otherwise form between said ends during operation at said outer surface.

The interlock means, in a further aspect, includes a male member depending from the first end and a female member depending from the second end, the female member having a locking recess, the female member comprising one piece integral sheet metal including a wall and a second projection distal to and spaced from the wall for locking engagement with the male member recess and including a third projection distal to the wall for resilient compressive interference with the anvil channel in cooperation with the wall for locking the male and female members to the anvil channel.

In a further aspect, the strip includes a sheet metal liner, the male member sheet metal being one piece and integral with and depending from the liner.

IN THE DRAWING

Figure 1:
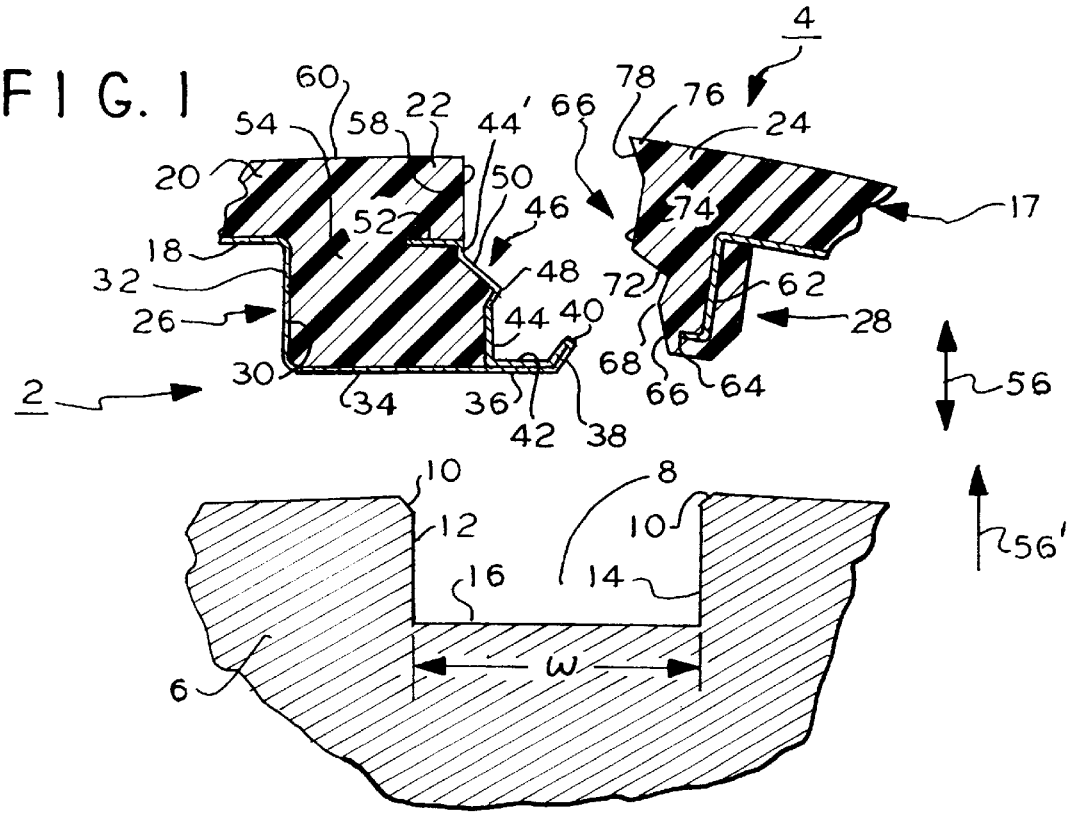
FIG. 1 is a side elevation fragmentary sectional view of a die cutter blanket and anvil locking arrangement according to one embodiment of the present invention prior to assembly of the locking arrangement to an anvil roller locking channel.
Figure 2:
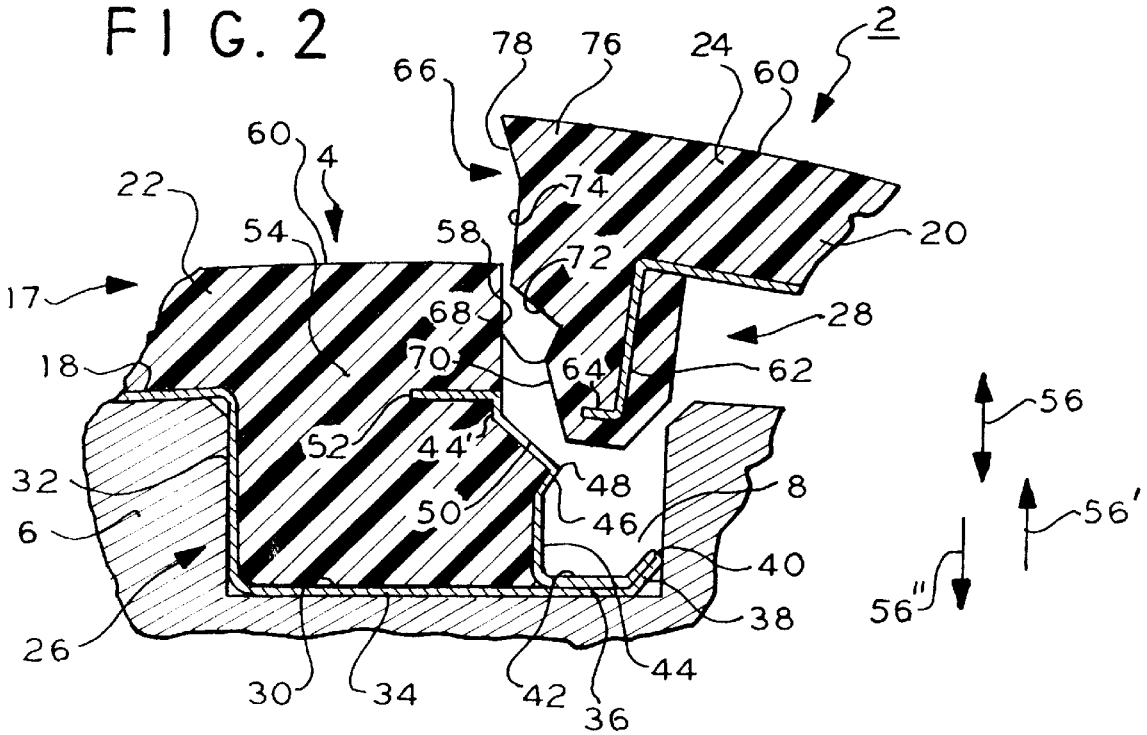
FIG. 2 is a view similar to that of FIG. 1 showing the locking engagement of the female locking member to the anvil roller channel prior to engagement and locking of the male locking member with the female member.

In FIGS. 1 and 2, blanket and roller assembly 2 comprises a blanket 4 which is wrapped about and releasably secured to preferably steel, circular cylindrical anvil roller 6. The roller 6 extends into and out of the plane of the drawing figure and is commercially available. The roller 6 has a conventional channel 8. The channel 8 extends for the length of the roller. The roller 6 is rotatably driven about a longitudinal axis normal to the plane of the drawing sheet by means not shown. The channel 8 has a rectangular shape in cross section as shown with chamfered edges 10, two parallel lateral side walls 12 and 14 and a transverse bottom or base wall 16.

The blanket 4 comprises an elongated normally flat rectangular strip 17 comprising a liner 18 to which a cutter penetrating sheet layer 20 is secured. Liner 18 is a relatively thin flexible sheet material and comprises thin sheet metal, e.g., preferably 26 gauge steel, forming a backing for the layer 20. The dimensions of the liner 18 and layer 20 combination are determined by the dimensions of the mating anvil roller 6. Typically for a roller of 20 inch diameter, the blanket 4 has a length of about 60 inches between ends 22 and 24 and generally a width into the plane of the drawing Figure of about 12 inches.

The layer 20 is formed from any known blanket materials such as polyurethane, polyvinyl chloride, chlorinated butyl rubber and so on and bonded to the liner 18. The layer thickness is typical as employed in prior art blankets. The layer 20 material is flexible and compressible.

The blanket 4 includes a female locking member 26 attached to end 22 and a male locking member 28 attached to end 24. The female member 26 comprises the liner 18 bent generally into a U-shaped channel 30 forming a one piece integral structure therewith. The channel 30 is formed by a depending wall 32 bent at right angles to the plane of the liner 18 forming a first lateral side wall of channel 30. The channel 30 is further formed by a base wall 34 wherein the liner 18 sheet material is bent at a right angle to the side wall 32. The base wall 34 is formed into an extension 36 coextensive therewith. The extension 36 extends beyond the channel 30 as shown and is preferably normal to wall 32.

The extension 36 includes an inclined lip 38 bent upwardly generally toward the layer 20 and terminating at distal edge 40. The edge 40 is spaced above the plane of the base wall 34. The edge 40 is formed by a fold of the sheet material which is folded over upon itself to form a double thickness layer in extension 36. The extension 36 is thus formed of two abutting juxtaposed layers which, except for the lip 38, are coextensive and coplanar with the channel 30 base wall 34. The upper layer 42 of the extension 36 is then bent at a right angle to the extension 36 to form a second lateral side wall 44 of the channel 30. Wall 44 is spaced from wall 32 forming a generally rectangular channel 30 that extends for the width of the strip 17 into and out of the plane of the drawing figures.

A region spaced from the extension 36 the side wall 44 is formed into a wedge shaped projection 46 that is generally triangular in section as shown having an apex 48. The projection is formed by two sides that are inclined relative to side wall 44 as shown. The projection 46 overlies a portion of the extension 36. The projection 46 has an upper wall 50 that extends inwardly into the channel 30 with a portion of wall 50 overlying a portion of the base wall 34 adjacent to the wall 44.

The sheet material of liner 18 is then bent upwardly from the projection 46 into lateral side wall portion 44' parallel to wall 44. The side wall 44, projection 46 and wall portion 44' together form a lateral side wall of the channel 30.

The sheet material of liner 18 is then bent inwardly toward the lateral side wall 32 forming an inwardly extending flange 52. Flange 52 overlies the base wall 34 and is generally coplanar with the liner 18. The entire structure described above for female member 26 extends into and out of the drawing figure for the length of the width of the strip 17.

The entire cavity 54 formed by and adjacent to channel 30 is filled with the material forming the layer 20 of the blanket 4 forming a homogeneous integral one piece construction. The material in cavity 54 thus forms a solid rigidifying backing for the sheet metal portion of the female member 26.

The extension 36 and lip 38, however, are cantilevered from this solid portion of the female member 26 and are relatively resilient in the directions 56. Directions 56 are the directions for insertion of the locking members 26 and 28 into and out of the anvil channel 8. In contrast, the projection 46 is rigid.

The strip 17 layer 20 has an end face 58 at the terminal end of blanket end 22. End face 58 is planar and coplanar with the exterior surface of wall portion 44. Face 58 is normal to the blanket outer surface 60 and normal to the plane of the strip layer 20. Face 58 extends for the full width of the strip 17 into and out of the drawing plane.

The walls 32, 34, 44, 44' and projection 46 are bonded to the material forming the blanket strip 17 simultaneously with the bonding of the layer 20 to the liner 18 when bond cast.

The male member 28 depends from the blanket 4 at end 24. The member 28 includes a reinforcing leg 62 and flange 64. Liner 18 is bent into a depending leg 62 normal to the plane of the liner 18 and strip 17. Flange 64 is normal to leg 62 and extends in a direction parallel to but outwardly away from the blanket end 24. Leg 62 and flange 64 extend for the entire width of the blanket strip 17 into and out of the plane of the drawing. The leg 62 and flange 64 are totally embedded in the material forming the strip 17 forming the male member and bonded thereto during such formation. The male member 28 is also a one piece homogeneous molded structure.

The terminal end face 66, FIGS. 1 and 2, of the male member 28 is formed with several configurations. The depending tip face 70 of the male member 28 at face 66 is inclined and terminates at apex 68. Apex 68 mates with and engages the junction between female member 26 projection 46 and wall 44, FIG. 3. The face 70 has a triangular recess channel 72. Channel 72 closely receives and mates with the female member projection 46 in the engaged locked state of FIG. 3.

A face portion 74 of face 66 extends normal to the plane of the strip 17 from recess 72 to wedge projection 76. This portion 74 is parallel to and abuts face 58 of the female member 26 in the locked engaged state of FIG. 3. Wedge projection 76 has an inclined face 78 which is inclined relative to face 74 and outer strip surface 60. A surface of the projection 76 is an extension of and coplanar with surface 60 forming a continuous surface therewith.

The projection 76, FIGS. 1 and 2, extends outwardly and away from the strip 17 face 74. The projection 76 thus extends toward the female end 22 of the blanket during installation onto the anvil 6. The projection 76 face 78 preferably is about 20° relative to the plane of face 74. The projection 76 depends from the surface 60 a distance that is preferably less than one half the thickness of the blanket strip layer 20, and preferably about 40% of that thickness. Thus the projection 76 has an extent from surface 60 less than the extent of the face 74. The projection 76 being formed of the same material as the strip 17 is deformable and compressible.

In operation, the blanket 4 is assembled to the anvil as follows. The female member 26 is first inserted into the anvil channel 6, FIG. 2. The length of the member 26 between the lip 38 edge 40 and the exterior surface of lateral side wall 32 is slightly greater than the corresponding width w, FIG. 1, of the anvil channel 8. As the female member 26 is inserted into the channel 8, there is interference fit of the extension 36 with the channel 8 side wall 14 and the member lateral side wall 32 with the channel side wall 12.

The extension lip 38 edge 40 slides along the channel 8 wall 14, bending the extension somewhat in direction 56' upon insertion into the channel 8. The extension 36 being relatively resilient in directions 56 flexes in direction 56' to accommodate this insertion. The edge 40 engages the channel 8 wall 14 in tight interference loaded friction relation in a somewhat one way clutch-like action. The resiliently induced high stress concentration of the edge 40 on the wall 14 provides a relatively high friction load against the wall 14, locking the female member in the channel 8. This precludes unassisted accidental withdrawal of the female member 26 from the channel 8 in direction 56' while the male member 28 is being locked in place to the position of FIG. 3.

The male member 28 is then inserted into engagement with the female member 26 after the female member 26 is installed as in FIG. 2. During this insertion the apex 68 on the male member face 66 snaps past the projection 46 on the female member by compressive deformation of the male member. After partial insertion of the male member into the female member, FIG. 2, the projection 76 on the male member first engages the end face 58 and surface 60 of the strip 17.

Figure 3:
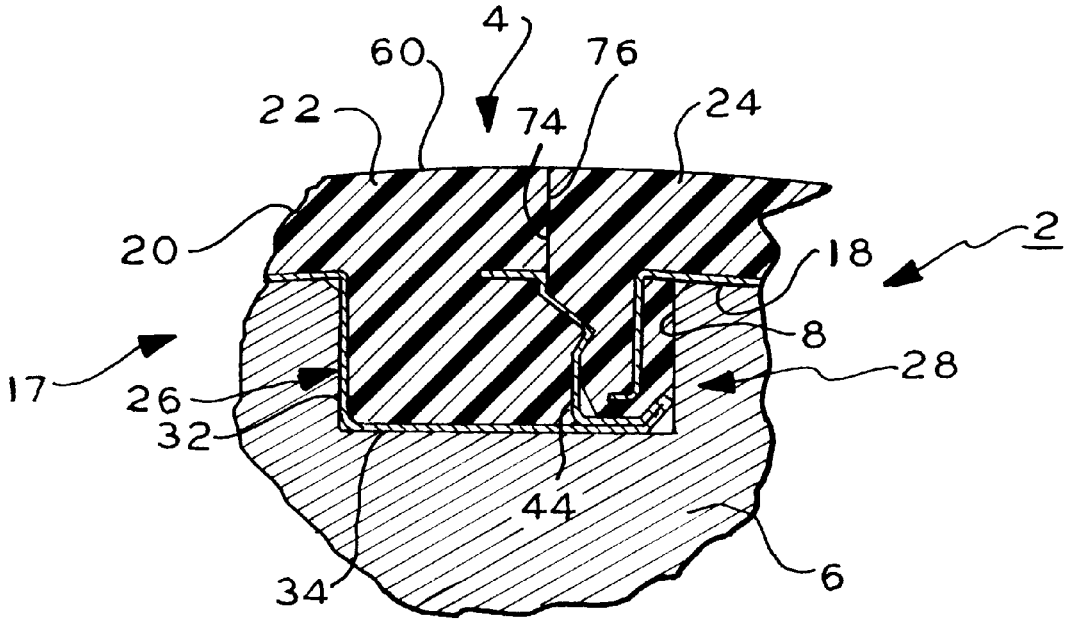
FIG. 3 is a view similar to that of FIG. 2 showing locking engagement of the male and female members.
Figure 4:
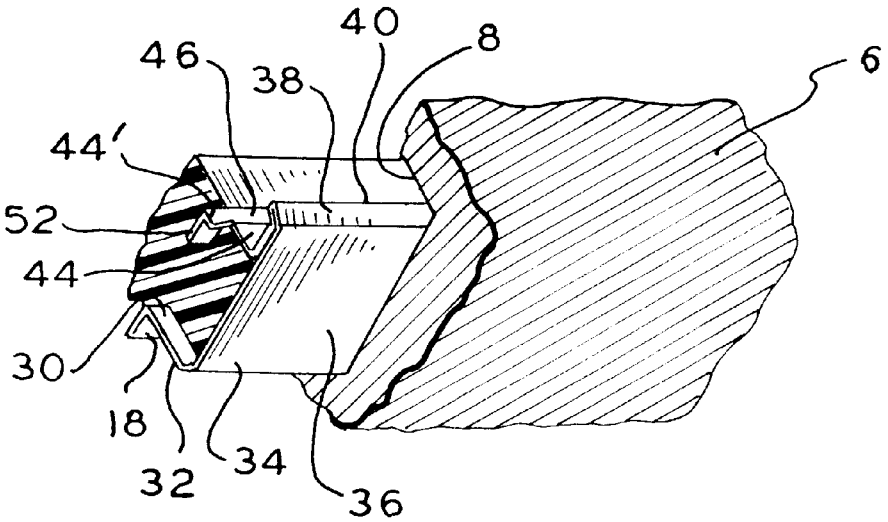
FIG. 4 is an isometric fragmentary sectional view of the female member engaged in the anvil roller channel as shown in FIG. 2.

The projection 76 is in interference engagement with the female member at end face 58 and surface 60 during insertion of the male member into engagement with the female member. As the male member is further forced into the locked state of FIG. 3, the projection 76 is deformed and compressed. When fully inserted the face 66 of the projection 76 is compressed by the mating face 58 of the female member so as to substantially be deformed into continuous single planar face 74, FIG. 3. FIG. 3 is exaggerated to show this relation.

The projection 76 extends an extent from surface 60 that is only partial the extent of adjacent face 74, FIG. 2. This is so that as the male member is inserted in direction 56", FIG. 2, a substantial portion of the male member is inserted before interference of the projection 76 with the face 58 of the female member is encountered. This to minimize insertion resistance of the male member by the interference engagement of the projection 76 with face 58.

The purpose of projection 76 is to minimize the occurrence of a gap between the face 58 and corresponding mating face 74 of the male member during operation of the blanket assembly 2. During such operation with prior art blanket assemblies, it has been observed that a gap is presented between the opposing end faces of the male and female members. The reason for this gap is not understood as explained in the introductory portion. This gap presents problems with the operation of the mating cutting dies.

By providing the compressed material at projection 76, as the end faces of the mating male and female members tend to separate to form a gap, the compressed material of the projection 76 expands, filling the gap at and adjacent to the surface 60. It has been observed that the gap is wedge shaped and extends for the entire thickness of the blanket strip. However, the entire gap need not be filled. Only that portion at the surface 60 is filled to improve the die cutting action. This is done by providing support for the web material being cut at the interface between the blanket end faces.

Prior attempts to fill the resulting gap with a further projection were not successful. Such prior attempts attempted to include a wedge shaped projection for the full width of the blanket strip thickness. This was not successful because the projection interfered with installation of the male member into the female member in an early phase of the insertion. That is, the projection depended for such a long extent from the blanket surface such as surface 60 that it engaged the face of the opposing female member in a manner to significantly preclude insertion of the male member. It should be noted that the insertion of the male member requires overcoming other interference surfaces to provide the normal prior art locking action between the male and female members.

The present invention projection 76 is a result of the recognition that the projection need not fill the entire resulting gap between the blanket end faces. The projection 76 need only provide a continuous surface 60 for the proper die cutting of the web material. Therefore, its extent from surface 60 is minimized only as necessary to fill the ensuing gap during operation of the blanket. This also minimizes insertion resistance of the male member into the female member, providing a practical arrangement for addressing the end face gap problem.

It will occur to one of ordinary skill that various modifications may be made to the disclosed embodiments without departing from the scope of the invention as defined in the appended claims. The disclosed embodiments are given by way of illustration and not limitation.

For example, while a projection 76 is shown on the face of the male member, it could also be formed on the corresponding face of the female member. Also, a similar projection may be formed on both opposing faces of the male and female members.

While the female member is shown in the preferred embodiment as one piece with the liner 18, it could also be formed of sheet metal separately and attached to the liner as by rivets and the like. The latter arrangement is more costly. Also, while the liner is shown as sheet metal, it may be formed of other sheet materials, such as high strength synthetic materials including Kevlar, a polyamide, carbon fiber layer such as impregnated carbon fiber tapes, fiberglass reinforced layers and so on.

While the extension 36 is preferably coplanar with the base wall 34, it may extend from the lateral side wall 44 in other locations. The projection 46 while wedge shaped may have other shapes according to a given implementation.

There thus has been shown and described a die cutter blanket for an anvil roll having an anvil channel with opposing side walls. The blanket includes a flexible strip having first and second ends, the strip for wrapping about the anvil so the first and second ends are adjacent to each other. A female locking member is secured to the first end, the member having interconnected spaced first and second opposing lateral side walls.

A locking projection and a relatively resilient anvil engaging element is included, each formed one piece and integral with the locking member and extending from the first lateral side wall in spaced relation to each other, the element and second lateral wall for locking the locking member and the strip first end to the anvil by compressive interference engagement with the anvil channel. A male locking member is secured to the blanket second end for locking engagement with the female member projection.

There also has been shown a strip with an outer surface distal the elements a first face between the projection and the surface on the first end being substantially normal to the surface, the strip second end having a recess for receiving the projection, the strip second end between the recess and surface having a second face next adjacent to the recess and substantially normal to the surface, the strip second end between the second face and surface forming a wedge projection extending from the second face and having a third face inclined relative to the second face.

What is claimed is:

1. A die cutter blanket for a roller anvil having an anvil channel with opposing side walls, said blanket comprising:

a flexible strip having first and second ends, said strip for wrapping about the anvil so the first and second ends are adjacent to each other;

a female locking member secured to the first end, said member having interconnected spaced first and second opposing lateral side walls;

said female locking member including a locking projection and a relatively resilient anvil engaging element, the projection and element being formed as one piece and extending from the first lateral wall in spaced relation to each other, the element and second lateral wall for locking the locking member and the strip first end to the anvil by compressive interference engagement with the anvil channel; and a male locking member secured to the blanket second end for locking engagement with said female member projection.

2. The blanket of claim 1 wherein the female member is sheet material and the element is generally planar having an edge distal the first lateral wall for resilient engagement of the element with the anvil in said compressive interference engagement.

3. The blanket of claim 1 wherein the blanket includes a sheet metal liner, the female member being formed as one piece and integral with the liner.

4. The blanket of claim 1 wherein the element and female locking member comprise sheet metal with the element having an edge distal the lateral first wall for said engagement with the anvil channel, a portion of the element adjacent to the edge being inclined relative to the portion adjacent to the lateral first wall.

5. The blanket of claim 4 wherein the portion adjacent to the lateral first wall is substantially normal to the first wall, said portions being formed of a doubled over layer of sheet material.

6. The blanket of claim 1 wherein said blanket includes a sheet metal liner secured to said strip, said female locking member comprising sheet metal secured to said liner, said female locking member comprising a U-shaped member with a base wall interconnecting said lateral side walls forming a further channel therewith, said element comprising an extension of said base wall and comprising a doubled over layer with an edge distal said lateral first wall, said lateral first wall forming said projection spaced from the element, and a lip extending inwardly toward the second lateral wall distal said element and overlying said base wall.

7. The blanket of claim 6 wherein the strip comprises material filling said further channel in a one piece integral construction and the liner and female locking member are one piece integral sheet metal.

8. The blanket of claim 1 wherein the strip has an outer surface distal said element, a first face between the projection and the outer surface on the first end being substantially normal to the outer surface, the strip second end having a recess for receiving the projection, the strip second end between the recess and outer surface having a second face adjacent to the recess and substantially normal to the outer surface, the strip second end between the second face and the outer surface forming a wedge projection extending from the second face and having a third face inclined relative to the second face.

9. The blanket of claim 8 wherein the wedge projection has an extent from the outer surface no greater than about 50% the distance from the strip outer surface to the recess.

10. The blanket of claim 8 wherein the strip is pliable and compressible, the wedge projection extending from the second face a distance so as to compress into and form a substantially continuous face with said second face in said locking engagement.

11. A blanket for a roller anvil having an anvil channel with opposing side walls, said blanket comprising:

a flexible compressible strip having opposing first and second ends, said strip for wrapping about the anvil forming a convex outer surface;

interlock means for locking the first and second ends together in locking engagement;

said first and second ends each including respective first and second channel engaging members each having a face depending generally normal to and from said outer surface a given extent; and a first projection extending away from at least one of said faces for a portion of said given extent in a region adjacent to said outer surface, said projection for engaging the other of said faces in interference compressive engagement during said locking engagement;

said projection being triangular in section, having a face inclined relative to and forming an apex with said outer surface and being coextensive with and contiguous with said outer surface.

12. The blanket of claim 11 wherein the projection is no more than about half the given extent.

13. The blanket of claim 11 wherein said interlock means includes a male member depending from the first end and a female member depending from the second end, the male member having a locking recess, the female member comprising one piece integral sheet metal including a wall and a second projection distal to and spaced from the wall for locking engagement with the male member recess and including a third projection distal to the wall for resilient compressive interference with said anvil channel in cooperation with the wall for locking said female member end to said anvil channel.

14. The blanket of claim 13 wherein the strip includes a sheet metal liner, said female member sheet metal being one piece and integral with and depending from the liner.

15. A die cutter blanket for a roller anvil having an anvil channel with opposing side walls, said blanket comprising:

a flexible strip having first and second ends, said strip for wrapping about the anvil so the first and second ends are adjacent to each other;

a female locking member secured to the first end, said member having interconnected spaced first and second opposing lateral side walls;

said female locking member including a locking projection and a relatively resilient anvil engaging element, the projection and element being formed as one piece and extending from the first lateral wall in spaced relation to each other, the element and second lateral wall for locking the locking member and the strip first end to the anvil by compressive interference engagement with the anvil channel; and a male locking member secured to the blanket second end for locking engagement with said female member projection;

the female locking member being U-shaped with a channel between said lateral first and second side walls, said locking member channel having a base wall, said element being substantially coextensive with and forming an extension of said base wall.

16. The blanket of claim 15 wherein the strip comprises thermoplastic material, a portion of said material filling said U-shaped channel and being one piece and integral with the strip.

17. A die cutter blanket for a roller anvil having an anvil channel with opposing side walls, said blanket comprising:

a flexible strip having first and second ends, said strip for wrapping about the anvil so the first and second ends are adjacent to each other;

a female locking member secured to the first end, said member having interconnected spaced first and second opposing lateral side walls;

said female locking member including a locking projection and a relatively resilient anvil engaging element, the projection and element being formed as one piece and extending from the first lateral wall in spaced relation to each other, the element and second lateral wall for locking the locking member and the strip first end to the anvil by compressive interference engagement with the anvil channel; and a male locking member secured to the blanket second end for locking engagement with said female member projection;

said projection being V-shaped with the apex of the V extending away from said lateral first and second walls.

18. A die cutter blanket for a roller anvil having an anvil channel with opposing side walls, said blanket comprising:

a flexible strip having first and second ends, said strip for wrapping about the anvil so the first and second ends are adjacent to each other;

a female locking member secured to the first end, said member having interconnected spaced first and second opposing lateral side walls;

said female locking member including a locking projection and a relatively resilient anvil engaging element, the projection and element being formed as one piece and extending from the first lateral wall in spaced relation to each other, the element and second lateral wall for locking the locking member and the strip first end to the anvil by compressive interference engagement with the anvil channel; and a male locking member secured to the blanket second end for locking engagement with said female member projection;

said element comprising folded over sheet material with the fold forming an edge distal said lateral first wall.

19. A blanket for a roller anvil having an anvil channel with opposing side walls, said blanket comprising:

a flexible compressible strip having opposing first and second ends, said strip for wrapping about the anvil forming a convex outer surface;

interlock means for locking the first and second ends together in locking engagement;

said first and second ends each including respective first and second channel engaging members each having a face depending generally normal to and from said outer surface a given extent; and a first projection extending away from at least one of said faces for a portion of said given extent in a region adjacent to said outer surface, said projection for engaging the other of said faces in interference compressive engagement during said locking engagement;

the interlock means including a male member depending from the first end and a female member depending from the second end, the male member having a locking recess, the female member comprising one piece integral sheet metal including a wall and a second projection distal to and spaced from the wall for locking engagement with the male member recess and including a third projection distal to the tall for resilient compressive interference with said anvil channel in cooperation with the wall for locking said female member end to said anvil channel.

* * * * *